US008864339B2

(12) United States Patent
Rotella et al.

(10) Patent No.: US 8,864,339 B2
(45) Date of Patent: Oct. 21, 2014

(54) THERMAL SOLUTION FOR LED CANDELABRA LAMPS

(75) Inventors: Anthony Michael Rotella, Cleveland, OH (US); Gary Robert Allen, Chesterland, OH (US); Benjamin Lee Yoder, Cleveland Heights, OH (US); David C. Dudik, Shaker Heights, OH (US); Charles Leigh Huddleston, II, Cleveland, OH (US); Thomas Alexander Knapp, Cleveland, OH (US)

(73) Assignee: GE Lighting Solutions, LLC, East Cleveland, OH (US)

( * ) Notice: Subject to any disclaimer, the term of this patent is extended or adjusted under 35 U.S.C. 154(b) by 4 days.

(21) Appl. No.: 13/604,684

(22) Filed: Sep. 6, 2012

(65) Prior Publication Data

US 2014/0063798 A1 Mar. 6, 2014

(51) Int. Cl.
*F21V 29/00* (2006.01)

(52) U.S. Cl.
USPC ..... 362/294; 362/311.02; 362/373

(58) Field of Classification Search
CPC ..... F21V 29/2225; F21V 29/2231
USPC ..... 362/294, 311.02, 373
See application file for complete search history.

(56) References Cited

U.S. PATENT DOCUMENTS

| | | | | |
|---|---|---|---|---|
| 2005/0174780 | A1* | 8/2005 | Park | 362/294 |
| 2007/0081339 | A1* | 4/2007 | Chung et al. | 362/294 |
| 2007/0097702 | A1* | 5/2007 | Crowder | 362/570 |
| 2009/0103295 | A1* | 4/2009 | Wang | 362/234 |
| 2011/0080096 | A1 | 4/2011 | Dudik et al. | |
| 2011/0080740 | A1 | 4/2011 | Allen et al. | |
| 2011/0080742 | A1 | 4/2011 | Allen et al. | |
| 2013/0194796 | A1* | 8/2013 | Progl | 362/235 |
| 2013/0277032 | A1* | 10/2013 | Huang | 165/185 |

* cited by examiner

*Primary Examiner* — Evan Dzierzynski

(74) *Attorney, Agent, or Firm* — Global Patent Operation; Peter T. DiMauro

(57) ABSTRACT

A lighting device that uses one or more LEDs, an optical element (e.g., diffuser), and a heat sink to provide thermal management is provided. The overall shape of the lighting device, particularly the heat sink, can be configured to imitate the appearance of a traditional incandescent candelabra lamp. One or more features are also provided to assist with the conduction of heat away from the LED(s) and to the heat sink. The lighting device can provide improved lumen output and light distribution.

26 Claims, 7 Drawing Sheets

THERMAL SOLUTION FOR LED CANDELABRA LAMPS

FIELD OF THE INVENTION

The subject matter of the present disclosure relates generally to candelabra lamps that use an LED light source.

BACKGROUND OF THE INVENTION

Candelabra lamps (also referred to as candelabra bulbs) can provide aesthetics that are appealing to certain consumers. Somewhat mimicking the shape of a candle flame, candelabra lamps may be used in e.g., chandeliers, sconces, candelabra, and other types of light fixtures. Incandescent versions can range from 4 to 100 watts with outputs ranging from 40 to 1400 lumens.

Lamps using light emitting diodes (LEDs) can have certain advantages over incandescent lamps. For example, LEDs are more energy efficient and can have a longer lifetime than incandescent lamps. Unfortunately, however, the performance of LEDs can be substantially affected by heat. While incandescents typically perform better as temperature increases, the performance (e.g., lumen output) of LEDs actually worsens as the temperature increases. As a result, for candelabra type lamps using an LED, the lumen output is typically quite low (e.g., 60 to 150 lumens) compared to incandescent versions (e.g., 90 to 600 lumens).

Aesthetics present an additional challenge for candelabra lamps. The volume of the lamp is typically small, which impacts the ability to dissipate heat. With incandescent candelabra lamps, typically a glass bulb or diffuser covers a filament and provides an aesthetically pleasing shape sought by certain consumers. However, the use of a glass bulb or diffuser with LEDs is disadvantageous. For example, a glass bulb or diffuser that surrounds the LED will also inhibit a convective air flow over the LED that might otherwise cool the LED.

Accordingly, a candelabra lamp that can use one or more LEDs as a light source would be useful. More particularly, such a candelabra lamp that can provide the desired lumen output while also providing adequate thermal management of the LED(s) would be particularly useful. Such a lamp that can also be designed with aesthetics appealing to consumers and/or that can imitate conventional incandescent candelabra lamps would also be beneficial.

BRIEF DESCRIPTION OF THE INVENTION

The present invention provides a lighting device that uses one or more LEDs, an optical element (e.g., a diffuser), and a heat sink to provide thermal management. The overall shape of the lighting device, particularly the heat sink, can be configured to imitate the appearance of a conventional incandescent candelabra lamp. One or more features are also provided to assist with the conduction of heat away from the LED(s) and to the heat sink. The lighting device can provide improved lumen output and light distribution as well as other benefits. Additional aspects and advantages of the invention will be set forth in part in the following description, or may be apparent from the description, or may be learned through practice of the invention.

In one exemplary embodiment, the present invention provides a lighting device defining a longitudinal direction. The device includes a base for connecting the lighting device to a power source. A heat sink is provided that includes an annulus and a plurality of fins extending along the longitudinal direction from the annulus. At least one LED is located within the annulus of the heat sink. An optical element (e.g., a diffuser) is positioned to receive light from the at least one LED (e.g., is positioned proximate to the at least one LED), and positioned with the plurality of fins around the optical element. A circuit board may be connected with the at least one LED, which circuit board may be in thermal communication with the heat sink.

In another exemplary embodiment, the present invention provides a lighting device that includes a base for connecting the lighting device to a power source. A body is attached to the base. The body defines a cavity. A circuit board is supported by the body. A heat sink is provided that includes a bottom portion and a plurality of fins extending along a longitudinal direction of the lighting device and away from the bottom portion. The base defines an aperture. At least one LED is located at the aperture of the heat sink and is connected with the circuit board. A diffuser is positioned about the at least one LED and is configured to receive light therefrom.

In another exemplary aspect, the present invention provides a method of manufacturing a lighting device. The method includes the steps of stamping a heat sink out of a metal sheet, the heat sink comprising a bottom portion with fins extending therefrom for cooling the lighting device; folding the fins towards each other and away from the bottom portion to create the shape of a candelabra; providing a diffuser positioned about at least one LED light source; and positioning the fins proximate to the diffuser and around the LED light source.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of the same or similar reference numerals in different figures is used to indicate the same or similar features.

DETAILED DESCRIPTION OF THE INVENTION

Figure 1:
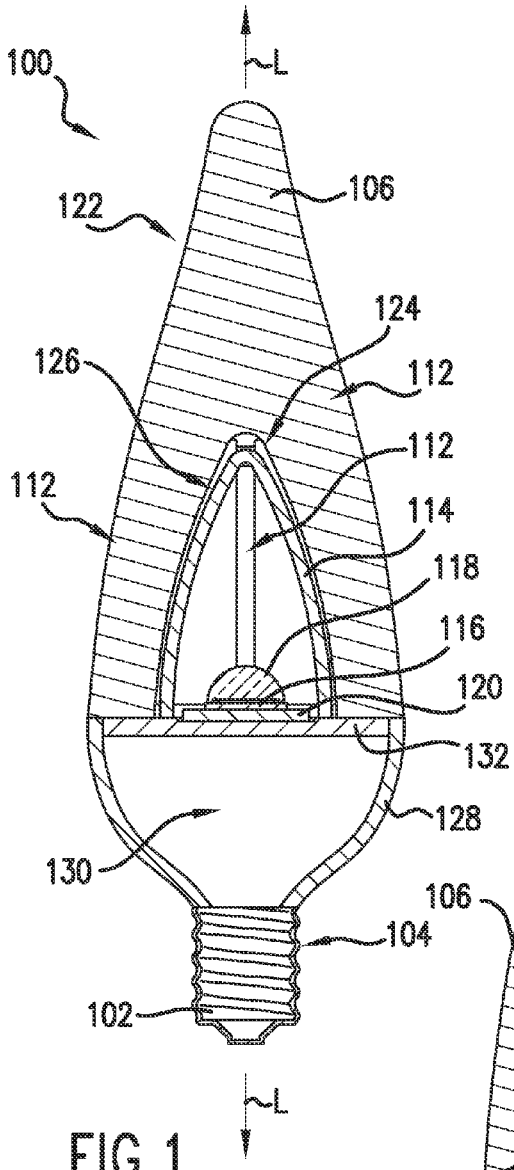
FIG. 1 provides a front, cross-sectional view of an exemplary embodiment of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
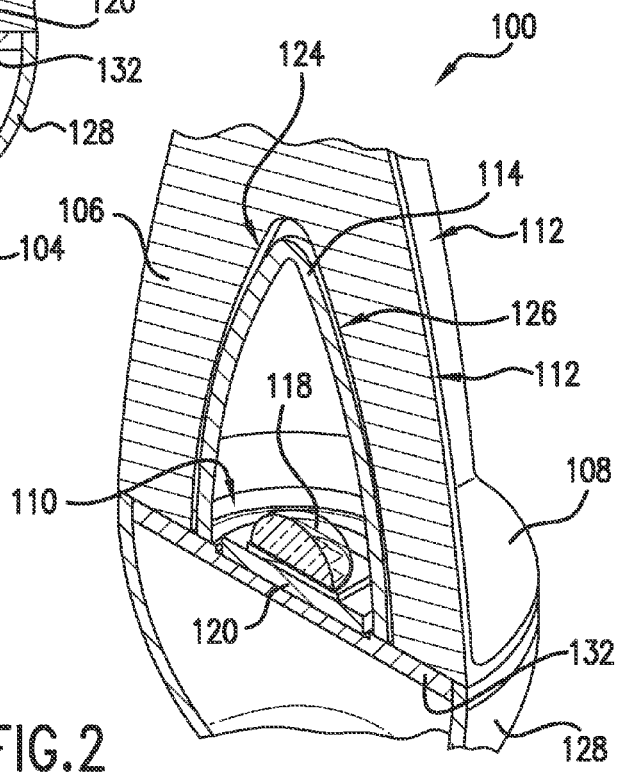
FIG. 2 is a perspective, cross-sectional view of the exemplary embodiment of FIG. 1.

An exemplary embodiment of a lighting device 100 of the present invention is shown in FIG. 1 in a front, cross-sectional view. FIG. 2 provides a cross-sectional, perspective view of a portion of lighting device 100. As shown, lighting device 100 defines a longitudinal direction L along its length, which in FIG. 1 is shown through the center of device 100.

Lighting device 100 includes a base 102 with threads 104 for mating receipt into e.g., a socket for providing power. The style shown for base 102 is commonly referred to as an "Edison" base. However, other types of bases including different features for connecting with a power source may be used as well.

Body 128 is connected to base 102 and defines a cavity 130. By way of example, drivers and other electronics for powering lighting device 100 and particularly one or more LEDs may be included in cavity 130. Body 128 may be constructed from e.g., plastics molded into a desired shape—particularly a shape suitable for use as a candelabra style lamp or lighting device. A metal or thermally conductive plastic may also be used.

A heat sink 106 is supported by body 128. For this exemplary embodiment, heat sink 106 is attached directly to body 128 using e.g., an epoxy and/or mechanical fasteners, which may include snaps, pins, internal threads, external threads, threaded fasteners, rivets, and others as well. Heat sink 106 is constructed from thermally conductive material. For example, heat sink 106 may be constructed from a metal such as aluminum.

Heat sink 106 also includes a plurality of vanes or fins 112 that extend along longitudinal direction L. More particularly, fins 112 extend from a bottom portion or annulus 108 of heat sink 106 towards a distal portion 122 of heat sink 106. At distal portion 122, fins 112 converge and taper to provide a shape that imitates a candle flame or a conventional candelabra type lamp. Other shapes may be used as well. Additionally, while heat sink 106 is shown with an exemplary construction that uses four fins 112, embodiments having a different number of fins may also be used including e.g., three, five, and others.

Annulus 112 of heat sink 106 defines an aperture or opening 110. One or more LEDs 116 are positioned on a circuit board 120 that is centrally located within opening 110. Non-centralized locations may be used as well. A protective dome 118 is positioned over LEDs 116. The LEDs may be e.g., located at a single point under dome 118 or provided in clusters at separate locations along circuit board 120. In other embodiments of the invention, LEDs without a protective dome may be used as well.

For this exemplary embodiment, a thermal spreader 132 is attached to circuit board 120 and to the annulus 108 of heat sink 106. Thermal spreader 132 is constructed from a thermally conductive material such as e.g., a metal. As such, thermal spreader 132 receives heat generated by LEDs 116 during operation and conducts the same to the annulus 108 of heat sink 106. The heat energy is then conducted along fins 112 towards distal portion 122. Through e.g., radiation and convection, this heat energy can then be dissipated from heat sink 106 to the air surrounding lighting device 100.

A diffuser 114 is also mounted onto thermal spreader 132 by e.g., epoxy or mechanical fasteners. Alternatively, the diffuser 114 could be mounted to heat sink 106 by e.g., a snap type fit or other connection technique. Diffuser 114 can be constructed from a variety of materials to e.g., control the color, distribution, and other aspects of the light rays emitted from LEDs 116. For example, diffuser 114 may be constructed from a substantially clear material such as glass or a translucent material. Diffuser 114 may be constructed with one or more phosphors to control the color and scattering of the light from LEDs 116. Diffuser 114 may also include micro-optics or facets on the interior and/or exterior surfaces for redirecting light into a preferable distribution. Other materials may be used as well. Alternatively, the diffuser 114 may be an optical element, such as an optical element 114 which comprises one or more of a diffuser, reflector, refractive element or transmissive element; or the like.

As shown in FIGS. 1 and 2, diffuser 114 is constructed with an external surface profile 126 that is shaped in a manner substantially similar to the internal surfaces 124 of fins 112. This construction provides an aesthetic effect to further imitate the flame-like or candelabra lamp appearance of lighting device 100. Other constructions, including different shapes, may be used for diffuser 114 as well.

Figure 3:
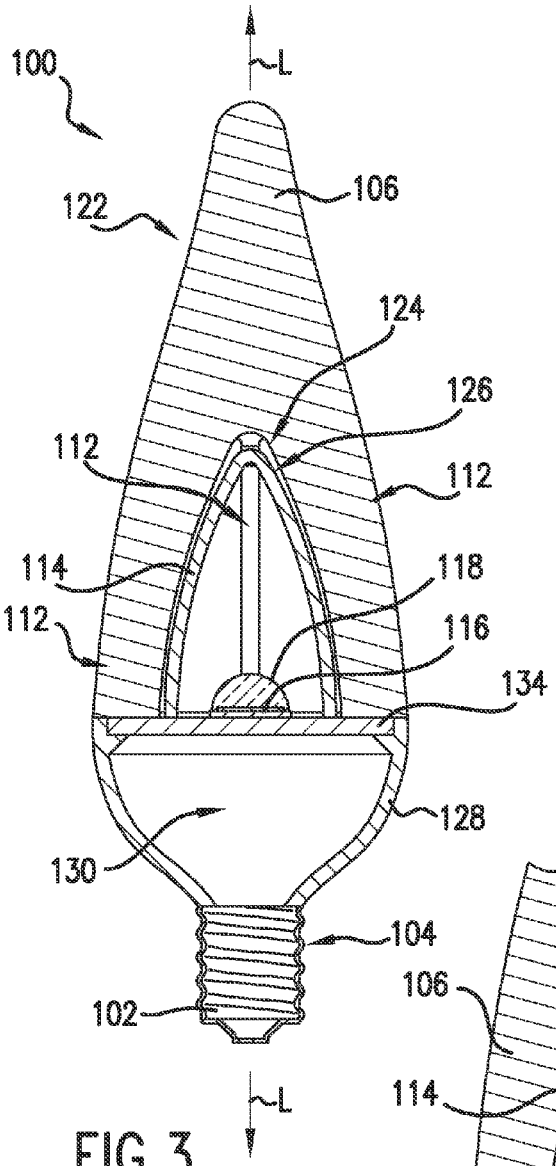
FIG. 3 provides a front, cross-sectional view of another exemplary embodiment of the present invention.
Figure 4:
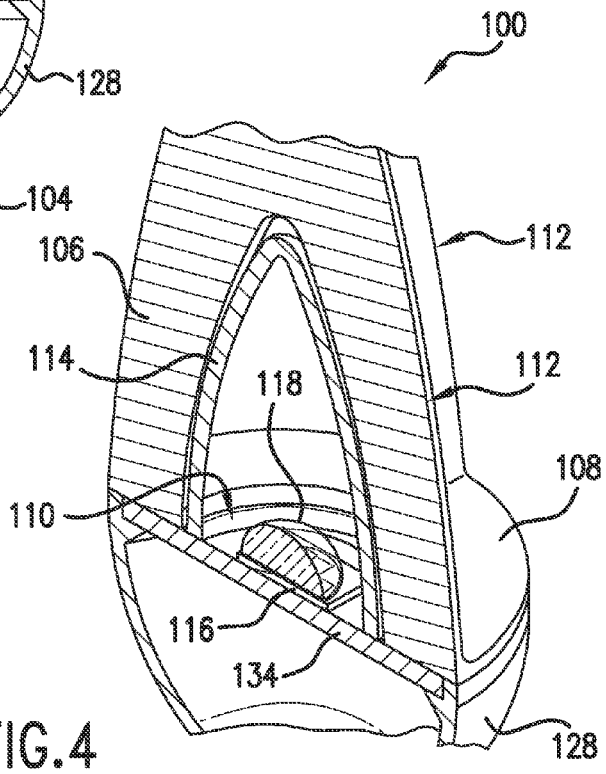
FIG. 4 is a perspective, cross sectional view of the exemplary embodiment of FIG. 3.

FIGS. 3 and 4 illustrate another exemplary embodiment of lighting device 100 similar to the exemplary embodiment of FIGS. 1 and 2. However, for the embodiment of FIGS. 3 and 4, one or more LEDs are positioned onto a thermal plate 134. Additionally, diffuser 114 and heat sink 106 are also connected to thermal plate 134 by e.g., epoxies and/or mechanical fasteners, which may include snaps, pins, internal threads, external threads, threaded fasteners, rivets, and/or other connection mechanisms as well.

Figure 5:
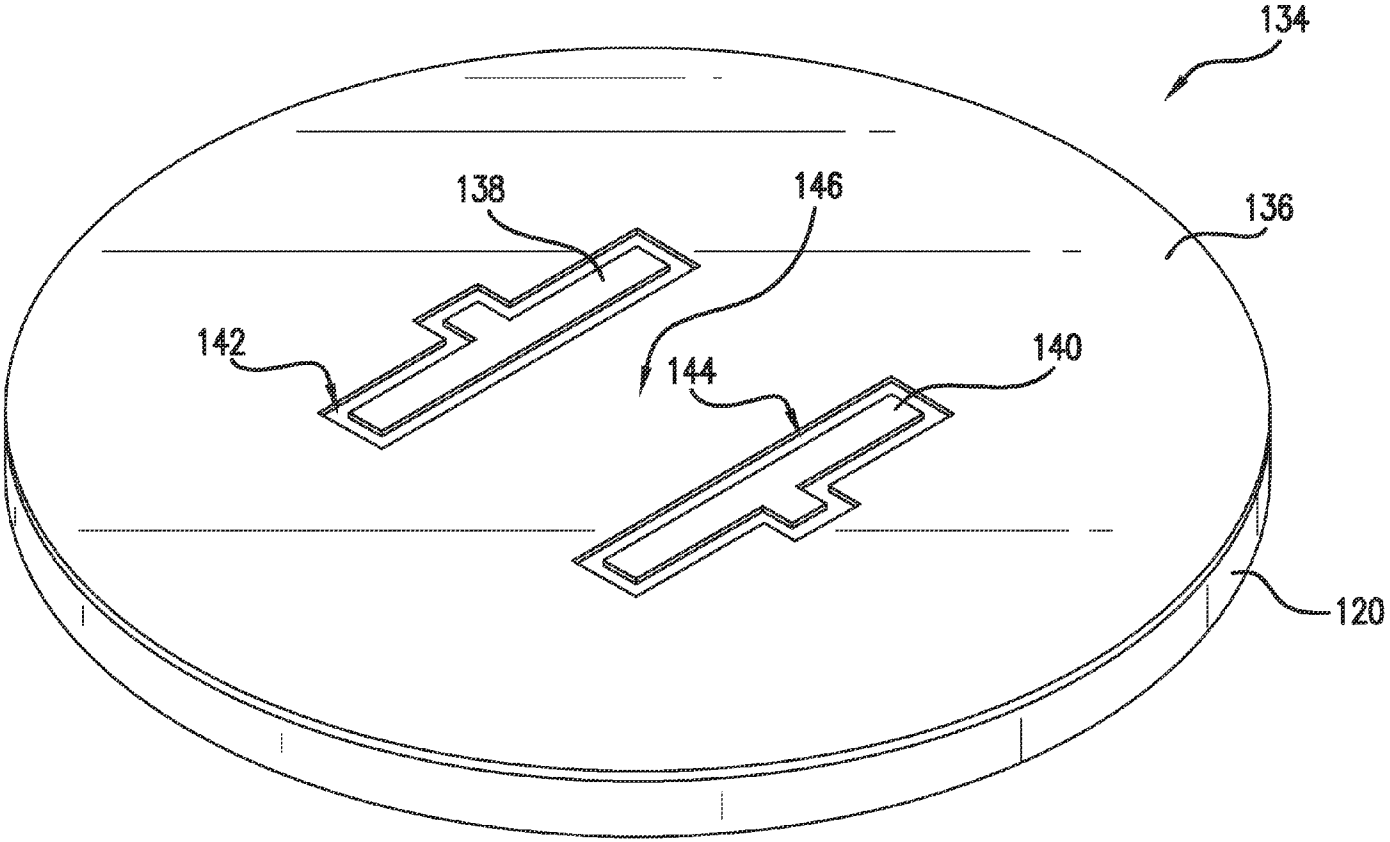
FIG. 5 provides a perspective view of an exemplary embodiment of a circuit board with a heat conducting layer attached.

A close-up, perspective view of thermal plate 134 is shown in FIG. 5. For this exemplary embodiment, thermal plate 134 includes a printed circuit board 120 onto which a heat conductive film or thin layer 136 has been applied. By way of example, heat conductive layer 136 may comprise a metal foil such constructed from copper.

One or more LEDs 116 are mounted to plate 134. More particularly, LEDs 116 have contacts or leads that are attached to and/or extend through portions 138 and 140. For example, portions 138 and 140 may be constructed from an electrically-conductive material such as copper. Portions 138 and 140 may be electrically connected with printed circuit board 120 and/or LEDs 116 may extend through portions 138 and 140 to connect with the circuit board 120. Breaks or gaps 142 and 144 electrically insulate portions 138 and 140 from heat conductive layer 136. A mask layer or other non-conductive film may be used between circuit board 120 and heat conductive layer 136 to electrically insulate circuit board 120 from layer 136.

LEDs 116 either rest upon or are positioned in close contact with layer 136 through central portion 146, which is located between portions 138 and 140. As such, some of the heat generated by LEDs 116 is conducted along heat conductive layer 136. In turn, heat sink 106 is in thermal communication with layer 136 by e.g., being attached to layer 136. Heat from LEDs 116 can then transfer through layer 136 and conduct through fins 112 towards distal portion 122. This heat conduction as well as convective cooling that will occur by air movement across fins 112 (due to buoyancy created by temperature differences) cools LEDs and circuit board 120.

In one exemplary embodiment, one or more LEDs may be mounted to thermal plate 134 through a pair of portions 138 and 140. However, as will be understood by one or skill in the art using the teachings disclosed herein, multiple pairs of e.g., electrically conductive portions 138 and 140 can be positioned at a plurality of locations across thermal plate 134. Thus, thermal plate 134 can be used to support and provide for thermal management of multiple LEDs at various locations thereon.

Figure 6:
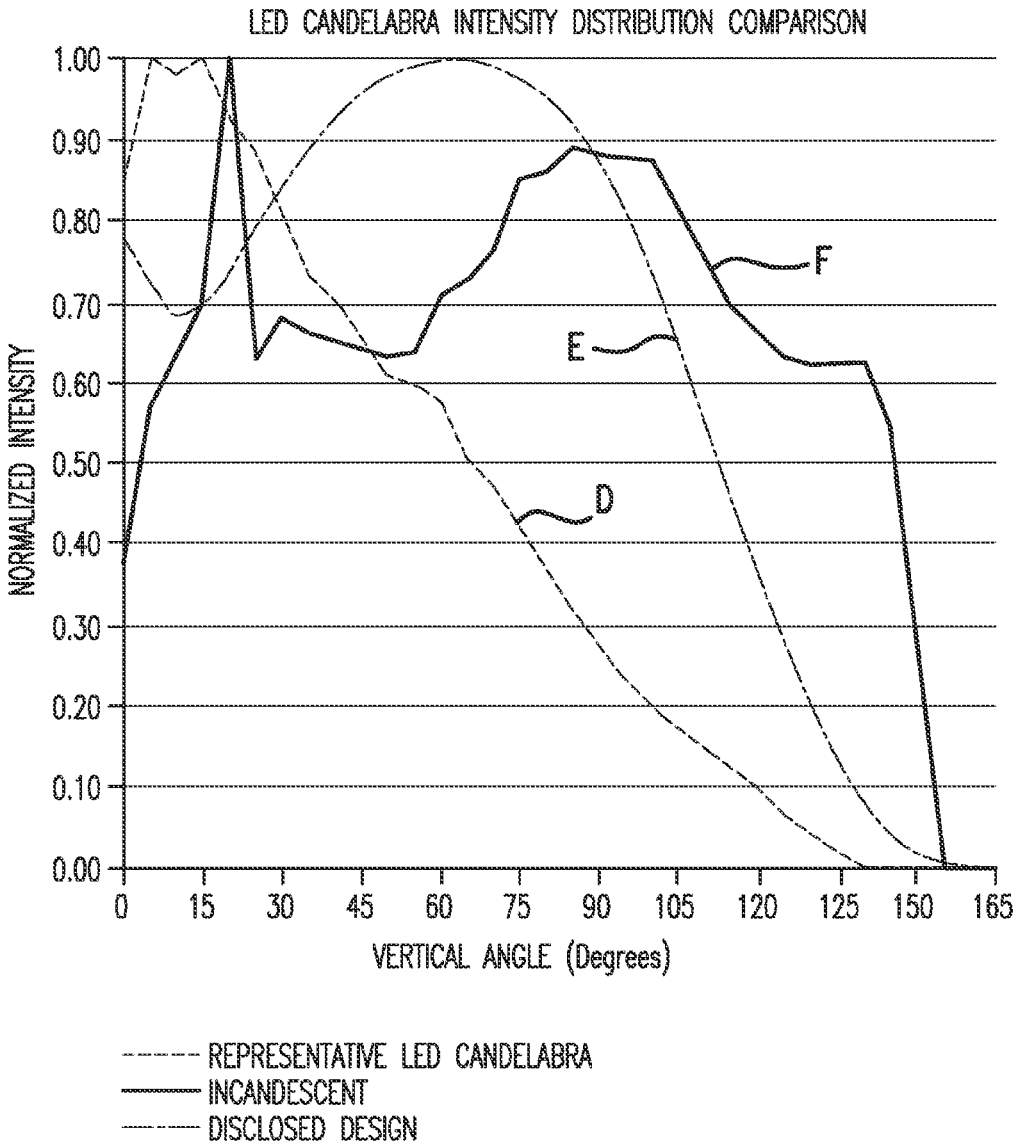
FIG. 6 is a plot of certain data as discussed further herein.

FIG. 6 provides a plot of the normalized light intensity distribution versus angle from the vertical i.e. longitudinal direction L of a conventional incandescent candelabra lamp (line F), a lighting device constructed with a heat sink and LED positioned as shown in FIGS. 1-4 (line E), and a representative LED (line D) candelabra lamp (one that uses an LED but without e.g., a heat sink 106 or the thermal management features of the present invention). For FIG. 6, a vertical angle of zero degrees represents a position directly above the lamp (e.g., opposite the threaded base 102) and along the longitudinal axis L at fixed distance from the light emitting source of the lamp. A vertical angle of e.g., 90 degrees represents a measurement at the same fixed distance from the light emitting source but at an angle of 90 degrees from longitudinal axis L.

As shown, the representative LED (line D) has an undesirable distribution of light intensity in that most of the light is directed overhead near the 0 degrees or the longitudinal axis L of the lamp. Conversely, the conventional incandescent candelabra lamp (line F) has a desirably more uniform distribution of light intensity from zero to about 150 degrees. Finally, a lighting device constructed according to exemplary embodiments of the present invention (line E) also shows a desirable, more uniform distribution of light intensity from zero to about 150 degrees.

It should also be noted that, in certain exemplary embodiments of the present invention, a higher light output can be obtained than with certain conventional LED candelabra type lamps lacking e.g., the thermal management features of the present invention. For example, a light output of 350 lumens or greater can be achieved using exemplary embodiments of the invention. In still another embodiment, a light output of 400 lumens or greater can be achieved using exemplary embodiments of the invention.

Figure 7:
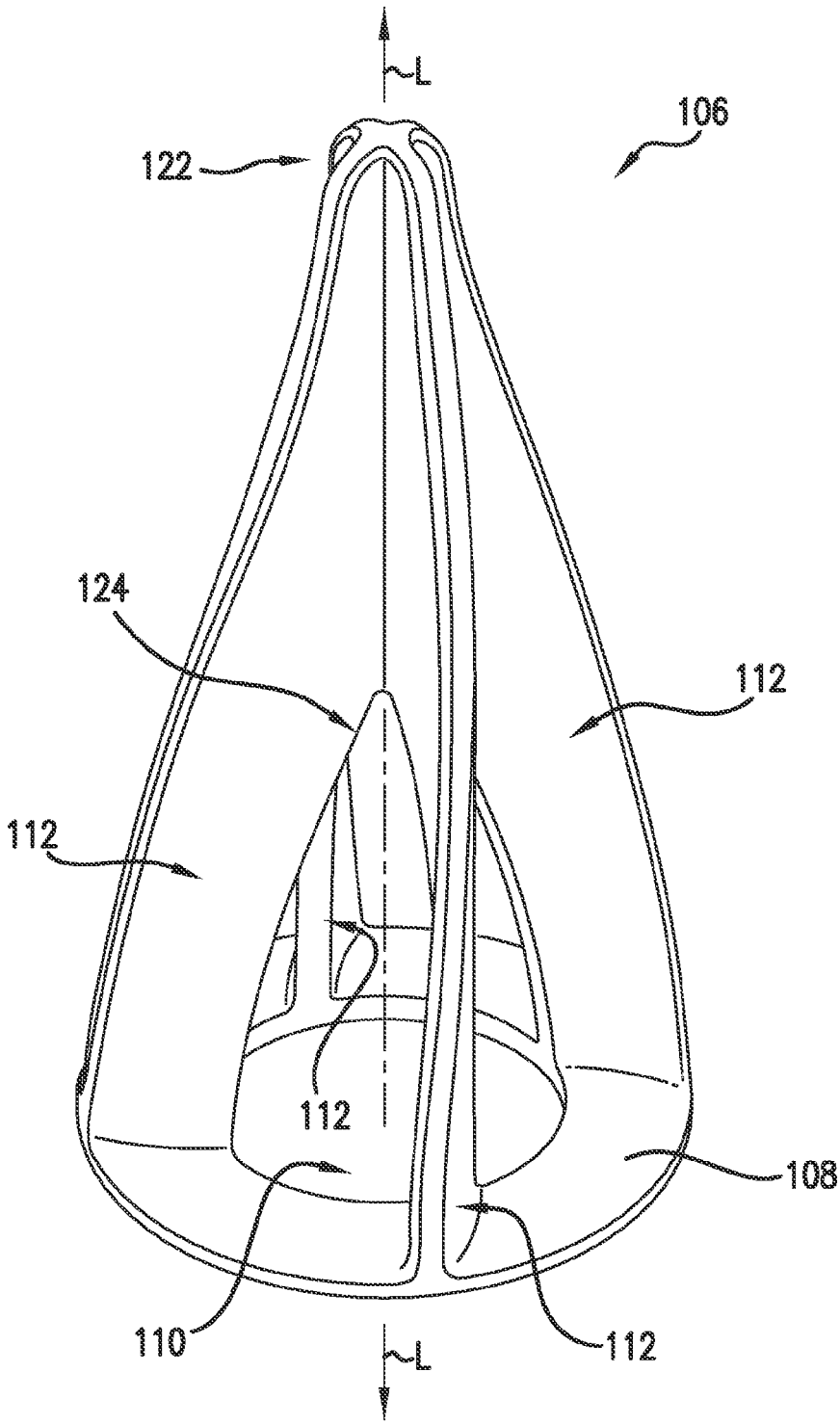
FIG. 7 is a perspective view of an exemplary heat sink of the present invention.

FIG. 7 illustrates another exemplary embodiment of a heat sink 106 of the present invention. For this embodiment, fins 112 undulate or include waves along the longitudinal direction between annulus 108 and distal portion 122. Other shapes may be used in addition to that shown. By way of example, FIG. 8 provides another exemplary embodiment of a heat sink 106 where fins converge at distal portion 122 but, unlike previous embodiments, are not connected at distal portion 122.

Figure 8:
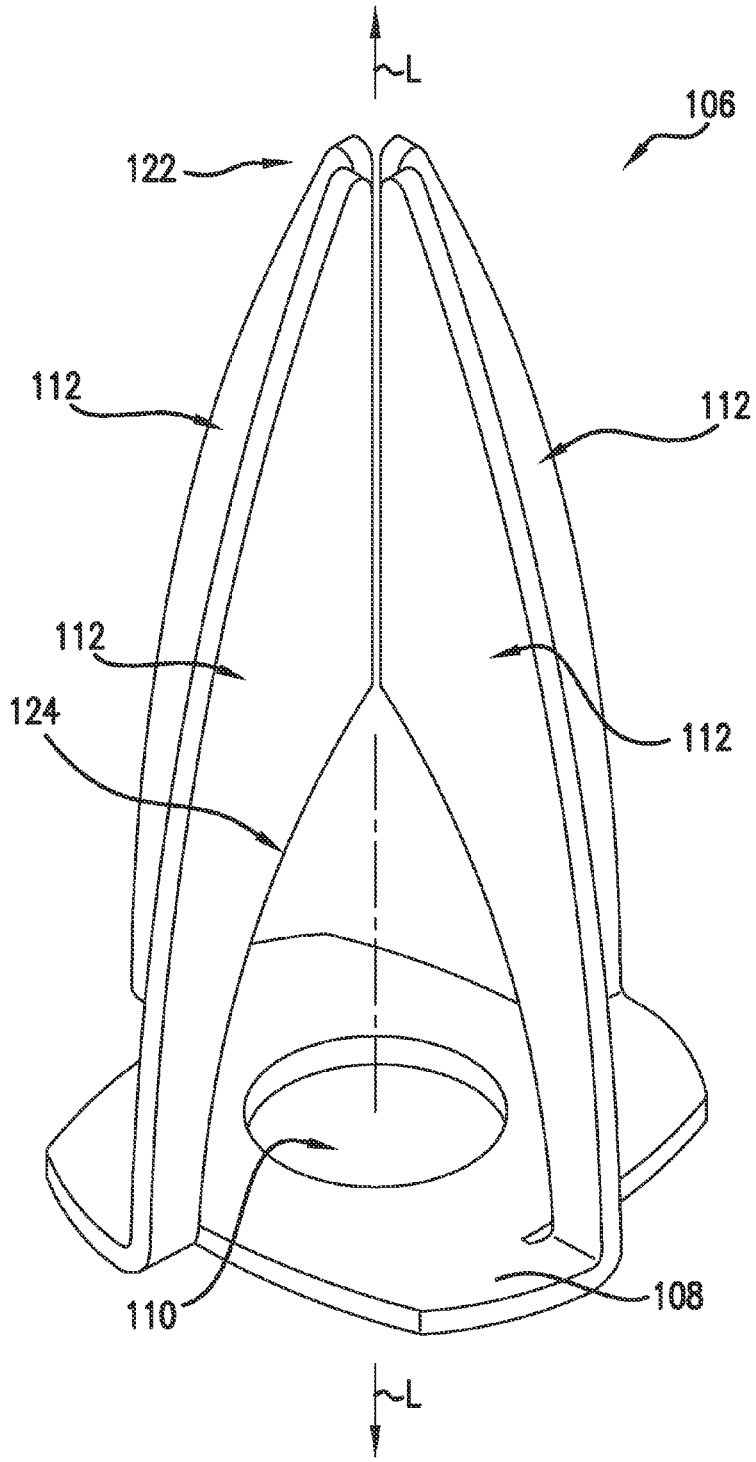
FIG. 8 is a perspective view of another exemplary heat sink of the present invention.
Figure 9:
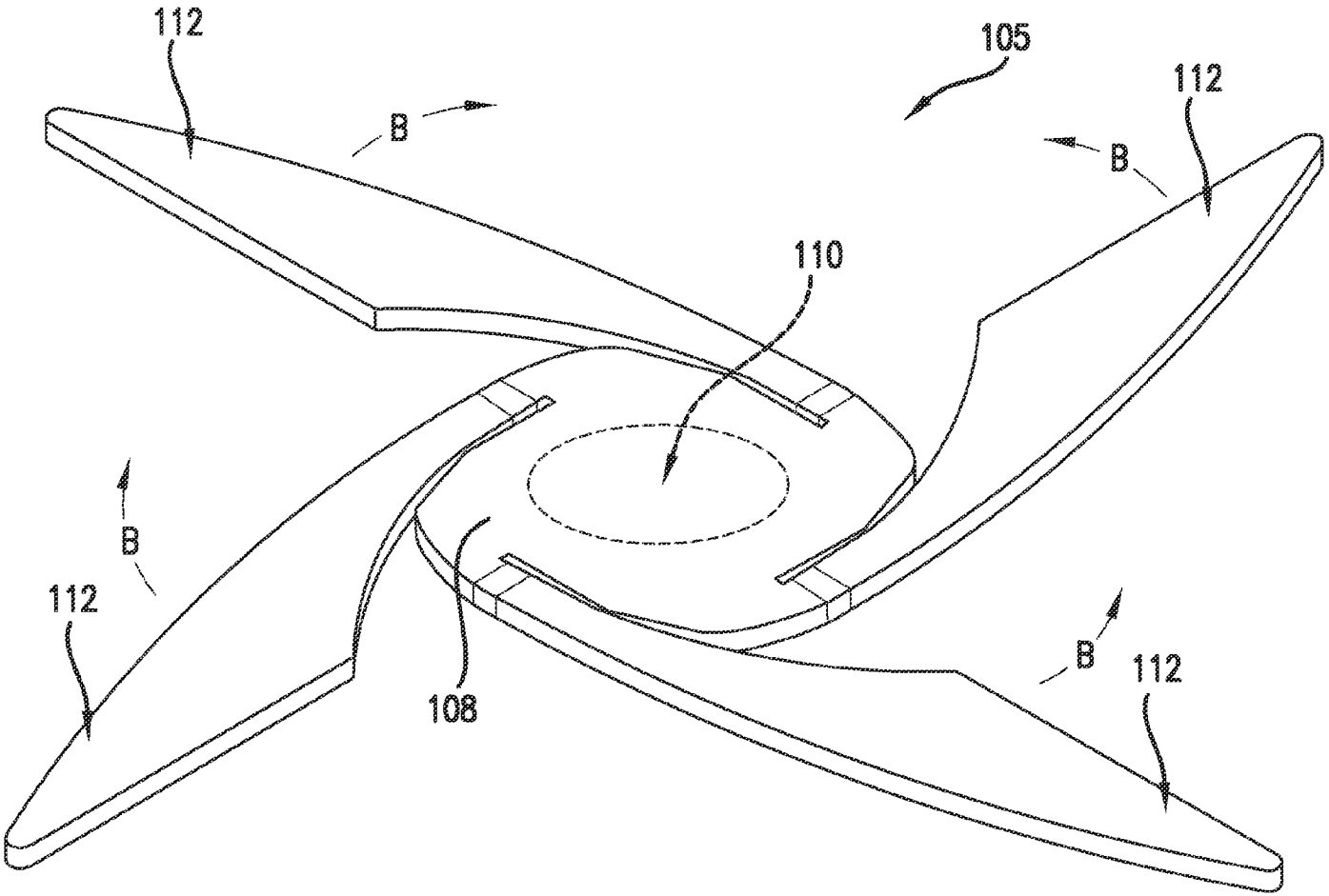
FIG. 9 is a perspective view illustrating part of an exemplary method for constructing the exemplary embodiment shown in FIG. 8.

The embodiment of FIG. 8 has certain advantages in manufacture. As shown in FIG. 9, a sheet of metal can be stamped to provide intermediate 105. A punch or other device can be used to create opening 110. Then, fins 112 can be folded upwardly as shown by arrows B to create the appearance shown in FIG. 8. Stamping metal is typically a more cost-effective method of manufacture than, e.g. casting, and offers flexibility in the design and assembly of the lamp. Namely, the heat sink 106 of FIG. 1-4 and FIG. 7 necessitates an opening 110 in part because the diffuser 114 cannot fit between neighboring fins 112 and still maintain the desired surface profile 126. It is also difficult to mount an LED and/or circuit board through the opening between neighboring fins 112 if there is no opening 110. The heat sink 106 of FIGS. 8 and 9 may or may not include opening 110. If opening 110 is included, the heat sink 106 of FIGS. 8 and 9 may have comparable thermal performance and outer profile to heat sink 106 of FIG. 1-4 and FIG. 7, but with the benefit of a cheaper method of manufacture. If opening 110 is excluded, the circuit board 120 and diffuser 114 may be attached to the heat sink 106 of FIG. 9 before the fins are bent into their upright position. Excluding opening 110 eliminates the need for an additional thermal spreader 132 since the circuit board 120 mounts directly to the heat sink 106. Direct attachment of the circuit board to the heat sink can improve thermal performance and reduce the part count of the assembly. Alternatively, the exclusion of opening 110 on a flat heat sink 105 allows the electrical traces of the circuit board to be printed directly to the heat sink 105, thereby eliminating the need for intermediate circuit board 120. The electrical traces on the heat sink 105 would connect with the power supply through openings in the heat sink. Once the LEDs and diffuser are mounted to the sheet heat sink 105, the fins are folded up as previously described. This assembly may further improve thermal performance and reduce part count of the assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A lighting device defining a longitudinal direction, the lighting device comprising:

a base for connecting the lighting device to a power source;

a heat sink comprising an annulus; and a plurality of fins extending along the longitudinal direction from the annulus, wherein said heat sink includes a distal portion located along the longitudinal direction and away from said base, and wherein said plurality of fins converge toward said distal portion;

at least one LED located within the annulus of said heat sink; and an optical element positioned to receive light from said at least one LED and positioned with the plurality of fins around the optical element.

2. A lighting device as in claim 1, wherein said fins define an arcuate profile.

3. A lighting device as in claim 1, wherein said fins are tapered in the longitudinal direction extending away from said base.

4. A lighting device as in claim 1, wherein said fins undulate along the longitudinal direction.

5. A lighting device as in claim 1, wherein said fins have an internal surface shaped in a manner substantially similar to an external surface of said optical element.

6. A lighting device as in claim 1, wherein the device further comprises a circuit board connected with said at least one LED, said circuit board in thermal communication with said heat sink.

7. A lighting device as in claim 6, wherein said at least one LED comprises a plurality of LEDs connected with said circuit board.

8. A lighting device as in claim 6, further comprising:

a thermal spreader attached with said circuit board and with the annulus of said heat sink, said thermal spreader configured for conducting heat away from said at least one LED and to said heat sink.

9. A lighting device as in claim 8, further comprising:

a body defining a cavity;

wherein said body is attached to said base and said thermal spreader.

10. A lighting device as in claim 8, wherein said heat sink and said thermal spreader comprise one or more metals.

11. A lighting device as in claim 6, further comprising:

a heat conductive layer supported on said circuit board and positioned between said at least one LED and said circuit board; and wherein the annulus of said heat sink is in thermal communication with said heat conductive layer of said circuit board.

12. A lighting device as in claim 11, wherein the annulus of said heat sink is attached to said heat conductive layer of said circuit board.

13. A lighting device as in claim 11, wherein said heat conductive layer comprises a metal film attached to said circuit board.

14. A lighting device as in claim 11, further comprising:

a plurality of electrically conductive portions supported on said circuit board; and wherein said at least one LED includes connectors extending into said plurality of electrically conductive portions.

15. A lighting device as in claim 14, wherein said plurality of electrically conductive portions are insulated from said heat conductive layer.

16. A lighting device as in claim 1, wherein the lighting device provides a light output of 300 lumens or greater.

17. A lighting device as in claim 1, wherein the optical element comprises one or more of a diffuser, reflector, refractive element or transmissive element.

18. A lighting device as in claim 1, herein the optical element is positioned proximate to said at least one LED.

19. A lighting device, comprising:

a base for connecting the lighting device to a power source;

a body attached to said base, said body defining a cavity;

a circuit board supported by said body;

a heat sink comprising a bottom portion and a plurality of fins extending along a longitudinal direction of the lighting device and away from the bottom portion, the base defining an aperture;

at least one LED located at the aperture of said heat sink and connected with said circuit board; and a diffuser positioned about said at least one LED and configured to receive light therefrom.

20. A lighting device as in claim 19, further comprising:

a thermal spreader connected to said body;

wherein said circuit board is attached to said thermal spreader and said heat sink is attached to said thermal spreader such that said thermal spreader is configured for conducting heat away from said at least one LED and to said heat sink.

21. A lighting device as in claim 19, further comprising:

a heat conductive layer supported on said circuit board and positioned between said at least one LED and said circuit board; and wherein the bottom portion of said heat sink is attached to said heat conductive layer of said circuit board.

22. A lighting device as in claim 21, wherein said heat conductive layer comprises a metal film attached to said circuit board.

23. A method of manufacturing a lighting device, comprising the steps of:

stamping a heat sink out of a metal sheet, the heat sink comprising a bottom portion with fins extending therefrom for cooling the lighting device;

folding the fins towards each other and away from the bottom portion to create the shape of a candelabra;

providing a diffuser positioned about at least one LED light source; and positioning the fins proximate to the diffuser and around the LED light source.

24. A method of manufacturing a lighting device as in claim 23, wherein the bottom portion includes an opening for positioning about the at least one LED light source.

25. A method of manufacturing a lighting device as in claim 23, further comprising the step of mourning a diffuser and a printed circuit board for the at least one LED light source to the bottom portion of the heat sink.

26. A lighting device defining a longitudinal direction, the lighting device comprising:

a base for connecting the lighting device to a power source;

a heat sink comprising an annulus; and a plurality of fins extending along the longitudinal direction from the annulus;

at least one LED located within the annulus of said heat sink; and an optical element positioned to receive light from said at least one LED and positioned with the plurality of fins around the optical element;

wherein said fins have an internal surface shaped in a manner substantially similar to an external surface of said optical element.

* * * * *

UNITED STATES PATENT AND TRADEMARK OFFICE

CERTIFICATE OF CORRECTION

PATENT NO. : 8,864,339 B2
APPLICATION NO. : 13/604684
DATED : October 21, 2014
INVENTOR(S) : Rotella et al.

It is certified that error appears in the above-identified patent and that said Letters Patent is hereby corrected as shown below:

Claims

In Column 7, Line 37, in Claim 18, delete “herein” and insert -- wherein --, therefor.

In Column 8, Line 31, in Claim 25, delete “mourning” and insert -- mounting --, therefor.

Signed and Sealed this
Twenty-seventh Day of October, 2015

Michelle K. Lee

Michelle K. Lee
*Director of the United States Patent and Trademark Office*